US009310059B2

(12) United States Patent
Zhang

(10) Patent No.: US 9,310,059 B2
(45) **Date of Patent: *Apr. 12, 2016**

(54) ROTARY PROJECTOR LIGHT

(71) Applicant: GEMMY INDUSTRIES CORPORATION, Coppell, TX (US)

(72) Inventor: Cheng-Chun Zhang, Shenzhen (CN)

(73) Assignee: Gemmy Industries Corp., Coppell, TX (US)

( * ) Notice: Subject to any disclaimer, the term of this patent is extended or adjusted under 35 U.S.C. 154(b) by 200 days.

This patent is subject to a terminal disclaimer.

(21) Appl. No.: 14/098,876

(22) Filed: Dec. 6, 2013

(65) Prior Publication Data

US 2015/0159842 A1 Jun. 11, 2015

(51) Int. Cl.

| | |
|---|---|
| ***F21V 21/30*** | (2006.01) |
| ***F21K 99/00*** | (2010.01) |
| ***F21V 31/00*** | (2006.01) |
| ***F21V 5/04*** | (2006.01) |
| *F21Y 101/02* | (2006.01) |

(52) U.S. Cl.

CPC . *F21V 21/30* (2013.01); *F21K 9/58* (2013.01); *F21V 5/04* (2013.01); *F21V 31/00* (2013.01); *F21Y 2101/02* (2013.01)

(58) Field of Classification Search

CPC ..... F21V 21/30; F21V 5/04; F21V 31/00; F21Y 2101/02; F21K 9/58; G02B 27/123

See application file for complete search history.

(56) References Cited

U.S. PATENT DOCUMENTS

| | | | | |
|---|---|---|---|---|
| 3,263,069 | A | 7/1966 | Krucki et al. | |
| 4,249,331 | A | 2/1981 | Vernon | |
| 4,870,548 | A | 9/1989 | Beachy et al. | |
| 5,688,042 | A | 11/1997 | Madadi et al. | |
| 6,019,493 | A * | 2/2000 | Kuo | F21V 5/008 116/63 R |
| 6,474,837 | B1 | 11/2002 | Belliveau | |
| 6,786,793 | B1 | 9/2004 | Wang | |
| 7,033,037 | B2 | 4/2006 | Chen | |
| 7,063,553 | B1 | 6/2006 | Mullen | |
| 7,320,533 | B1 | 1/2008 | Beadle | |
| 8,262,252 | B2 | 9/2012 | Bergman et al. | |
| 2003/0231497 | A1 | 12/2003 | Sakata et al. | |
| 2005/0243560 | A1 * | 11/2005 | Chen | F21S 10/00 362/328 |
| 2006/0239006 | A1 * | 10/2006 | Chaves | F21K 9/00 362/294 |
| 2007/0097681 | A1 * | 5/2007 | Chich | F21S 10/00 362/232 |
| 2009/0122548 | A1 | 5/2009 | Dalsgaard | |

(Continued)

OTHER PUBLICATIONS

Office Action issued Apr. 9, 2015 in U.S. Appl. No. 14/098,594.

(Continued)

*Primary Examiner* — Mary Ellen Bowman

(74) *Attorney, Agent, or Firm* — Venable LLP; Steven J. Schwarz

(57) ABSTRACT

A rotary projector light can include a lamp case defining a hollow mounting chamber and having an open front end; a power supply located inside the lamp case, the power supply connected to a power cable adapted to connect to an external power source; a motor located inside the lamp case, the motor electrically connected to the power supply and having a spindle; a positioning seat mounted on the spindle; a plurality of light emitting diode (LED) elements located on the positioning seat, the LED elements electrically connected to the power supply; and a beam-splitting lens cover located on the open front end of the lamp case. The beam-splitting lens cover can have an inner surface with multiple convex lenses directed at multiple refraction angles.

14 Claims, 6 Drawing Sheets

(56) References Cited

U.S. PATENT DOCUMENTS

| | | | |
|---|---|---|---|
| 2009/0268466 | A1 | 10/2009 | Allegri |
| 2010/0091491 | A1 | 4/2010 | Jiang et al. |
| 2011/0194292 | A1 | 8/2011 | Tsai |
| 2011/0286200 | A1 | 11/2011 | Iimura et al. |
| 2012/0147609 | A1 | 6/2012 | Black et al. |
| 2012/0182743 | A1 | 7/2012 | Chou |
| 2012/0300429 | A1 | 11/2012 | Jin |
| 2013/0094193 | A1 | 4/2013 | Baxter et al. |
| 2014/0001507 | A1 | 1/2014 | Streppel et al. |
| 2015/0131288 | A1* | 5/2015 | Zhang ..... F21V 14/06 362/277 |

OTHER PUBLICATIONS

Notice of Allowance issued Feb. 27, 2015 in U.S. Appl. No. 14/079,628.
Office Action issued Feb. 26, 2015 in U.S. Appl. No. 14/145,512.
Office Action issued Nov. 13, 2015 in U.S. Appl. No. 14/145,512.

* cited by examiner

ROTARY PROJECTOR LIGHT

BACKGROUND OF THE INVENTION

1. Field of the Invention

The present invention relates to a projector light, and more particularly, to a rotary projector light.

2. Description of the Related Art

Lighting plays a critical role on stage performance because of the creation of an animated and entertaining atmosphere. To provide diversified stage effect, stage equipment manufacturers have already designed a type of stage projector light that generates dynamic lighting effects. Such stage projector lights usually have a motor and a projector lamp. The projector lamp has a light source module and a light exit lens mounted inside a lamp enclosure. Given the variation of lights emitted by the light source module and refracted by the light exit lens, and the rotary and oscillating motion of the projector lamp driven by the motor, the projector lamp can create dynamic cloud lighting effects.

However, despite the foregoing dynamic cloud lighting effects, the conventional projector light has limitations when projecting light from different angles, onto a large area, and/or in a large occasion. Also, due to limited options for the color effect generated by the conventional projector light, the generated cloud lighting effects have not achieved the lighting effects expected by users.

SUMMARY

Embodiments of the present invention provide a rotary projector light to provide light of different colors projected at multiple angles, spread in a wide range of ambient environments, and to generate a diversified and animated light effect on the stage.

According to an embodiment, the rotary projector light has a lamp case, a support stand, a power supply, a motor, a light-emitting diode (LED) device, a watertight lens assembly and a beam-splitting lens cover.

According to an embodiment, the lamp case is hollow and has an open front end.

According to an embodiment, the support stand is mounted on a bottom of the lamp case.

According to an embodiment, the power supply is mounted inside the lamp case, and is connected to an external power cable mounted through the lamp case.

According to an embodiment, the motor is mounted inside the lamp case, is electrically connected to the power supply, and has a spindle and a positioning seat.

According to an embodiment, the spindle protrudes beyond the open front end.

According to an embodiment, the positioning seat is mounted around the spindle.

According to an embodiment, the LED device has multiple LED elements emitting light of different colors, is mounted on the positioning seat of the motor, and is electrically connected to the power supply.

According to an embodiment, the watertight lens assembly is mounted on the open front end of the lamp case and encloses the LED device in the watertight lens assembly.

According to an embodiment, the beam-splitting lens cover has a receiving space with a rear open end, encloses the watertight lens assembly in the beam-splitting lens cover, and further has multiple convex lenses with multiple refraction angles formed on an inner surface of the beam-splitting lens cover.

To prepare the operation of the foregoing rotary projector light, the support stand can be securely mounted in the ground or other fixture. When the LED elements emit light and the motor drives the LED device inside the beam-splitting lens cover, causing it to rotate, light with different colors emitted from the LED elements passes through the lens tube of the watertight lens assembly, is projected onto the beam-splitting lens cover, and is refracted by the convex lenses of the beam-splitting lens cover to scatter the light at multiple projection angles. This spreads the light in a wide range in the ambient environment for a diversified, animated, and colorful lighting effect. The beam-splitting lens cover has multiple convex lenses with multiple refraction angles.

Other objectives, advantages and novel features of the invention will become more apparent from the following detailed description when taken in conjunction with the accompanying drawings.

DETAILED DESCRIPTION

Figure 1:
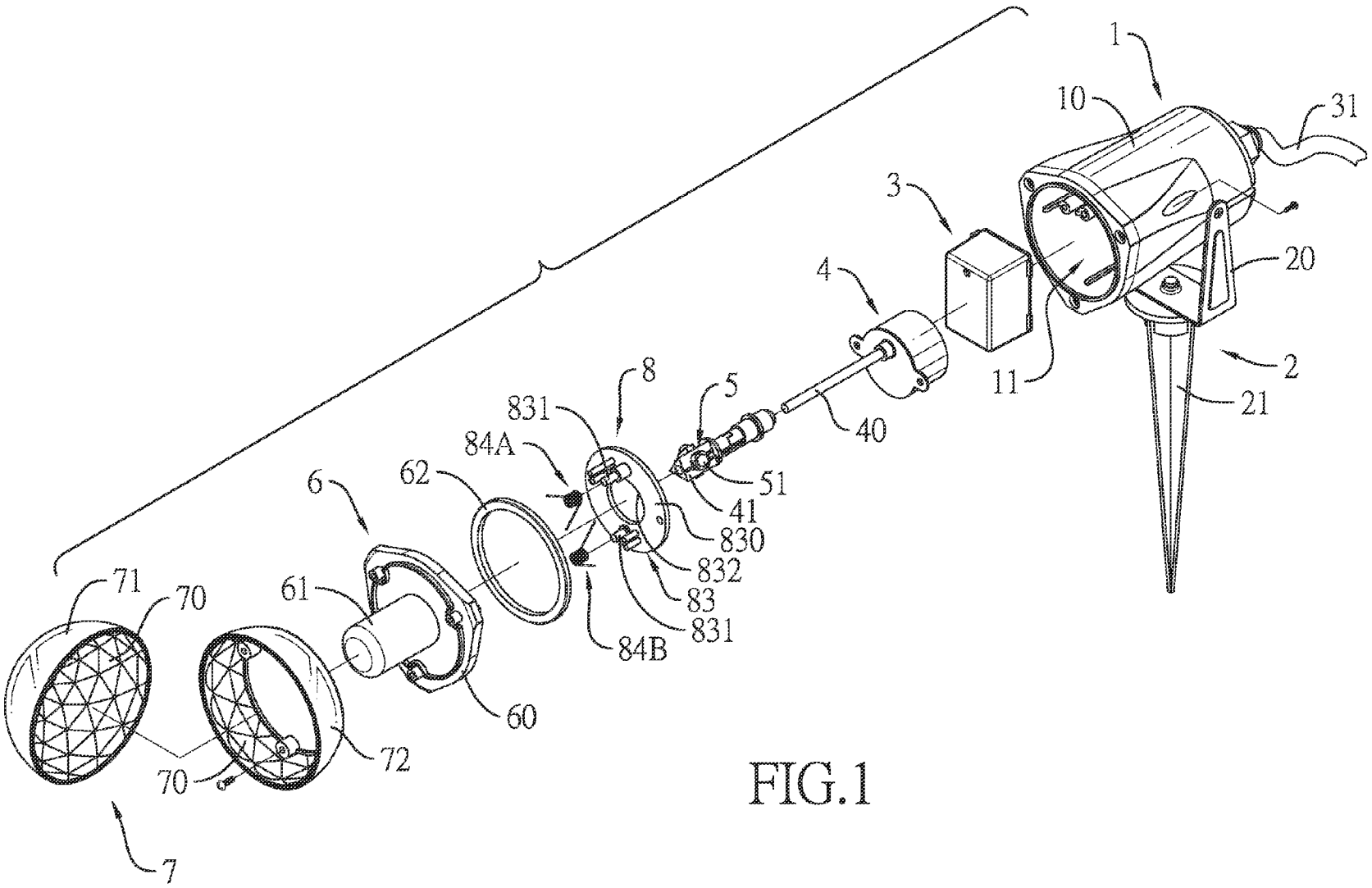
FIG. 1 is a partially exploded perspective view of a rotary projector light in accordance with an embodiment of the present invention.
Figure 2:
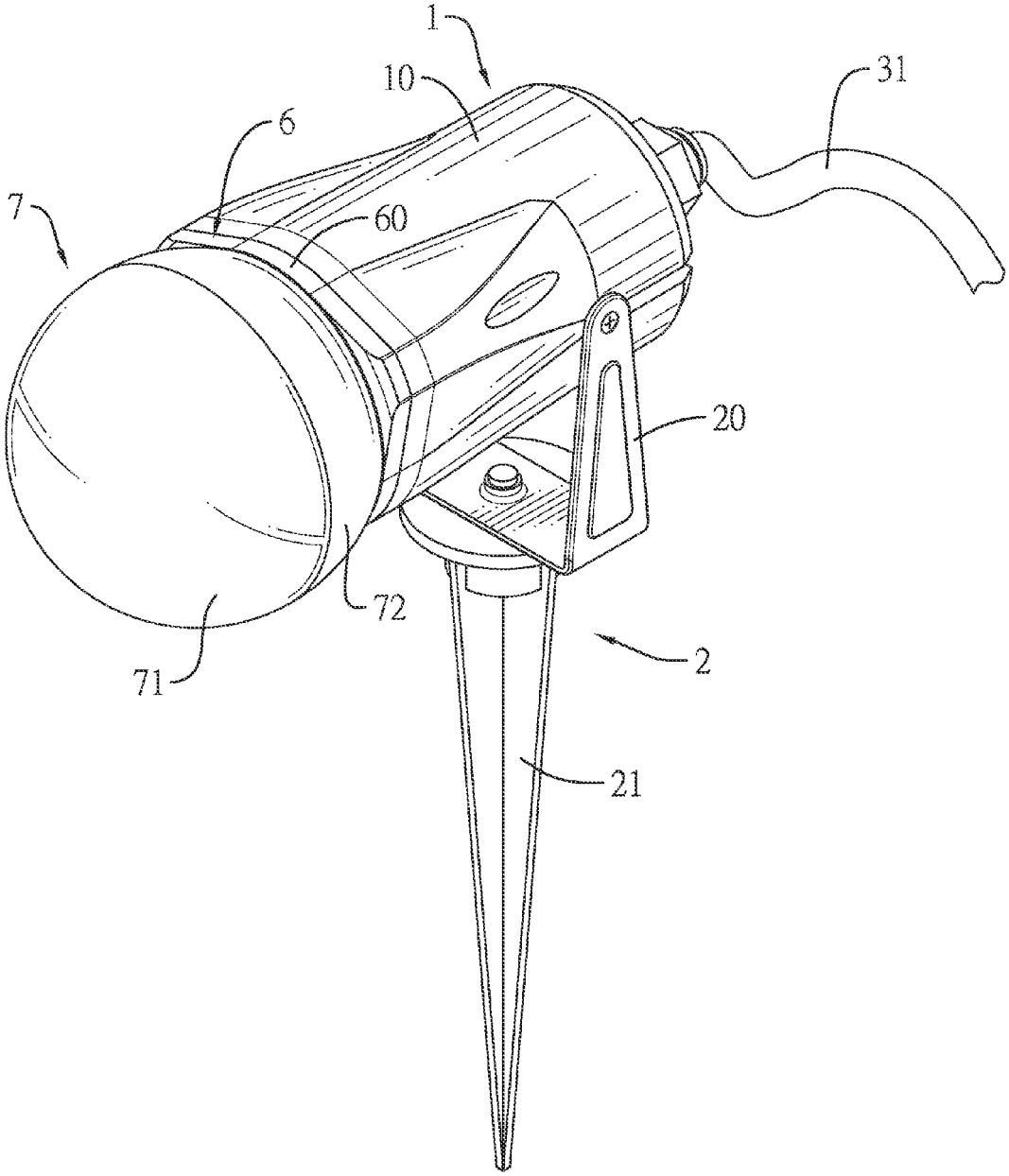
FIG. 2 is a perspective view of the rotary projector light shown in FIG. 1.
Figure 3:
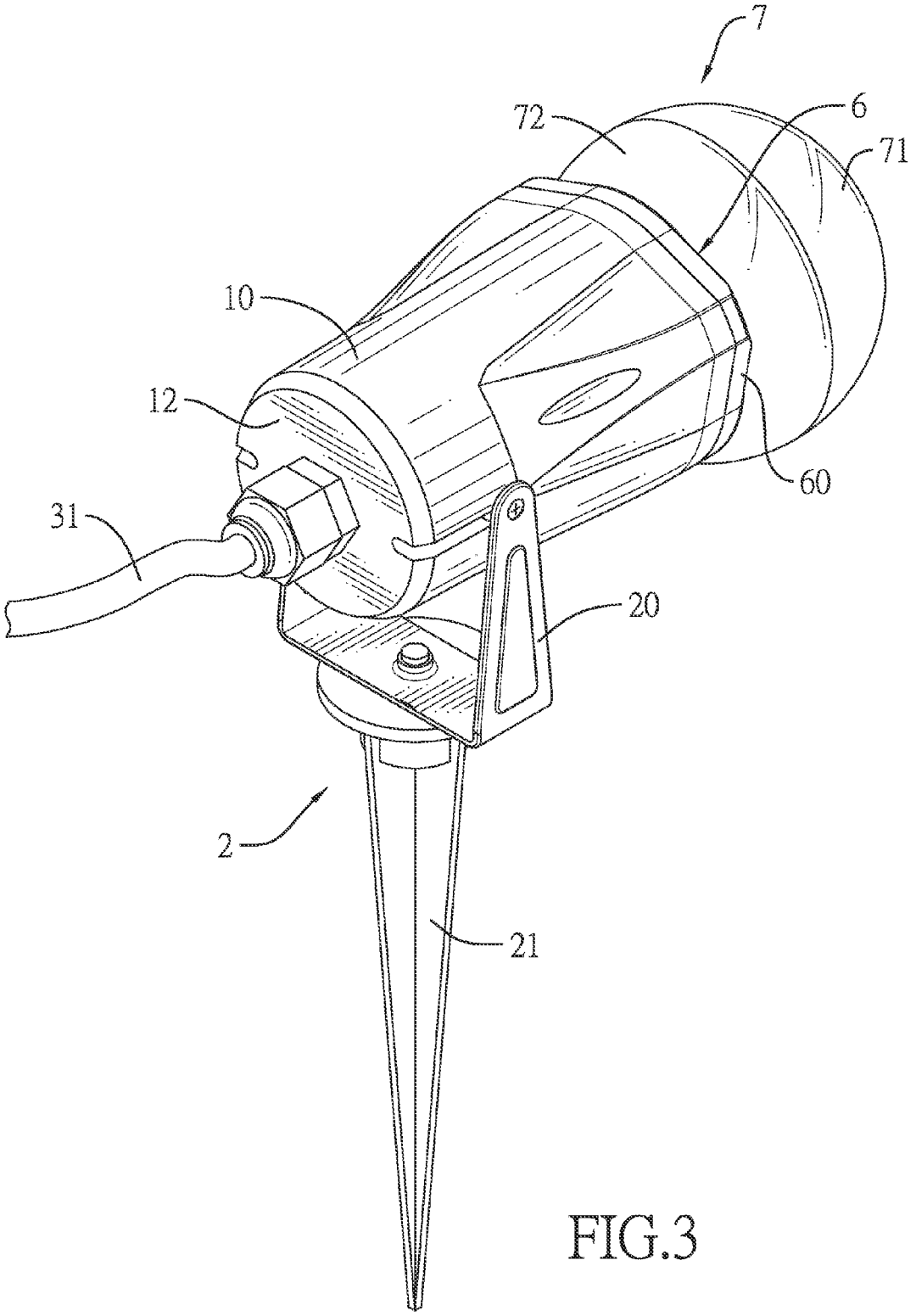
FIG. 3 is another perspective view of the rotary projector light shown in FIG. 2.

With reference to FIGS. 1 to 3, a rotary projector light in accordance with an embodiment of the present invention has a lamp case 1, a support stand 2, a power supply 3, a motor 4, a light-emitting diode (LED) device 5, a watertight lens assembly 6 and a beam-splitting lens cover 7.

The lamp case 1 is hollow with an open front end. In the present embodiment, the lamp case 1 has a peripheral wall 10, a mounting chamber 11 and a rear cover 12. The mounting chamber 11 is defined inside the lamp case 1 and surrounded by the peripheral wall 10, and the mounting chamber 11 communicates with the open front end. The rear cover 12 is mounted on a rear end of the peripheral wall 10 of the lamp case 1.

The support stand 2 is mounted on a bottom of the lamp case 1. In the present embodiment, the support stand 2 has a U-shaped bracket 20 and an insertion post 21. Two parallel bars of the U-shaped bracket 20 are mounted on two lateral portions of the peripheral wall 10 with a screw set to support the lamp case 1 so that the lamp case 1 is pivotable in a range of less than 360 degrees with respect to the U-shaped bracket 20. The insertion post 21 is tapered in a downward direction. A top end of the insertion post 21 is rotatably mounted on a central portion of a bottom of the U-shaped bracket 20 for the lamp case 1 to be horizontally rotated on the insertion post 21.

Figure 6:
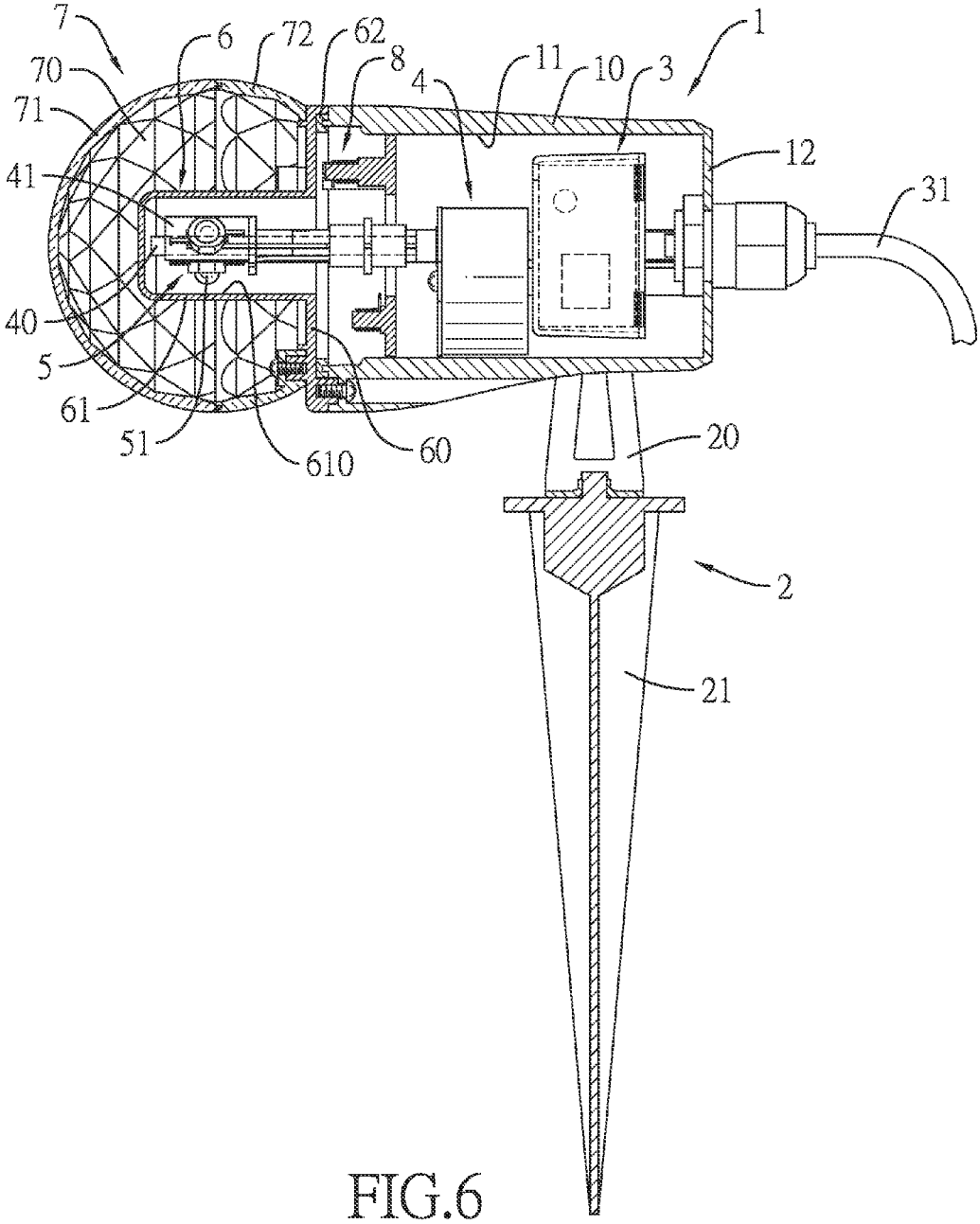
FIG. 6 is a side view in partial section of the rotary projector light of FIG. 2.

With reference to FIGS. 1 and 6, the power supply 3 is an AC (Alternating Current) to DC (Direct Current) device, is mounted inside the lamp case 1, and is connected to an external power cable 31. The power cable 31 is mounted through the rear cover 12 of the lamp case 1 for connecting to an external AC power source. The power supply 3 converts AC power inputted from the external AC power source into DC power, and supplies the DC power to the motor 4 and the LED device 5 for operation.

With reference to FIGS. 1 and 4 to 6, the motor 4 is mounted inside the mounting chamber 11 of the lamp case 1, is electrically connected to the power supply 3, and has a spindle 40 and a positioning seat 41. The spindle 40 protrudes beyond the open front end of the lamp case 1. The positioning seat 41 may be made of a heat-conducting material to have a heat-dissipating effect, takes the form of a polyhedron, and has multiple positioning faces 411 arranged around a center axis of the spindle 40. In the present embodiment, the positioning seat 41 is a triangular prism with three positioning faces 411.

The LED device 5 has multiple LED elements 51 emitting light of different colors. The LED elements 51 are respectively mounted on the positioning faces 411 of the positioning seat 41 mounted around the spindle 40 of the motor 4, and are electrically connected to the power supply 3 in a direct fashion or an indirect fashion through an electrical connection device 8. In the present embodiment, the LED device 5 has three LED elements 51 emitting light of three different colors, such as the three primary colors, red, green and blue. The colors of light emitted from the LED elements 51 can vary according to the operation demand of the rotary projector light.

Figure 4:
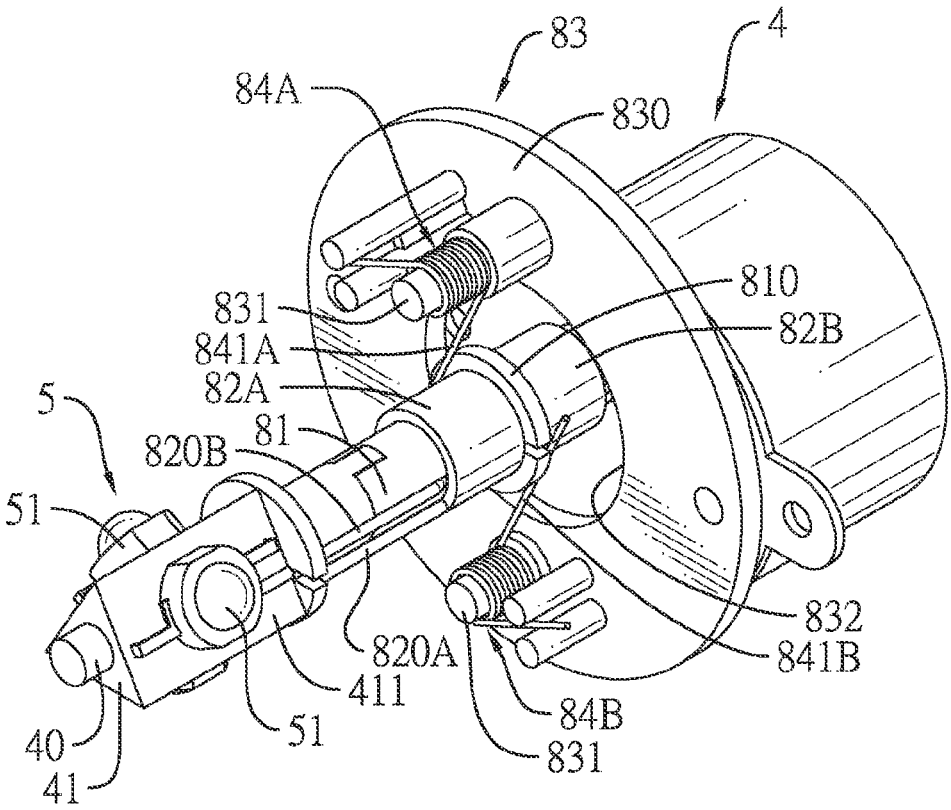
FIG. 4 is an enlarged perspective view of an assembly of a motor, an electrical connection device, and a light-emitting diode device (LED) of the rotary projector light of FIG. 1.
Figure 5:
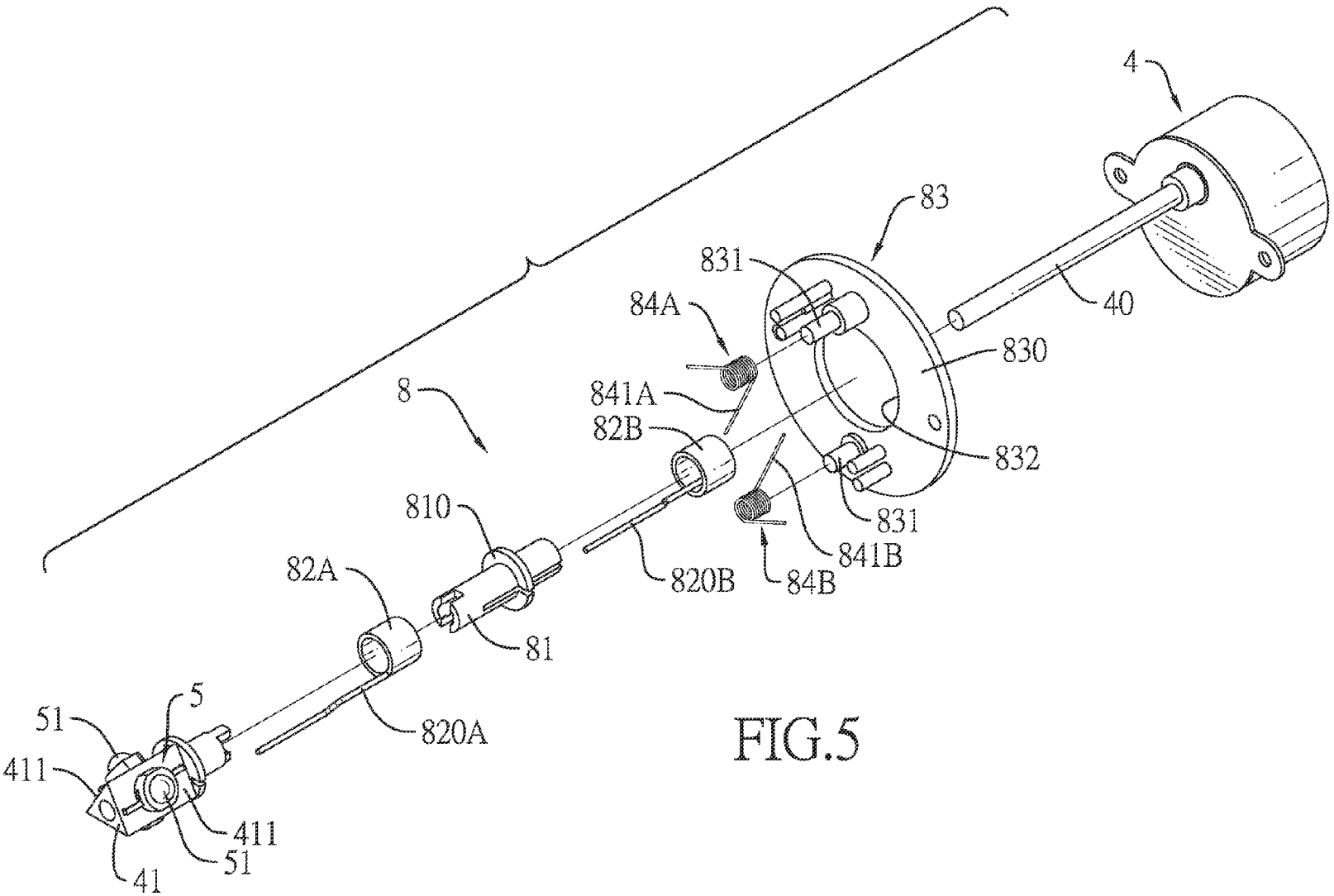
FIG. 5 is an exploded perspective view of the motor, the electrical connection device, and the LED device of FIG. 4.

With reference to FIGS. 1, 4 and 5, the electrical connection device 8 is mounted inside the mounting chamber 11 of the lamp case 1, is mounted between the motor 4 and the LED device 5, and has an insulating sleeve 81, two conductive rings 82A, 82B, a base 83 and two resilient conductive elements 84A, 84B. The insulating sleeve 81 is made of an insulating material, is securely mounted around the spindle 40 of the motor 4, is connected with the positioning seat 41, and has a partition flange 810 formed on and protruding outwards from a periphery of the insulating sleeve 81. The conductive rings 82A, 82B are securely mounted around two ends of the insulating sleeve 81, and the partition flange 810 is located between the two conductive rings 82A, 82B to isolate the two conductive rings 82A, 82B. Each conductive ring 82A, 82B has a conductive wire 820A, 820B connected to the positioning seat 41 and electrically connected to one of two electrodes of each LED element 51. The base 83 has a mounting board 830 and multiple pillars 831. The mounting board 830 is securely fastened on an interior of the peripheral wall 10 of the lamp case 1, and has a through hole 832 formed through the mounting board 830 for the spindle 40 of the motor 4, the insulating sleeve 81 and the conductive rings 82A, 82B to be mounted through the mounting board 830. The pillars 831 are formed on a front side of mounting board 830. The two resilient conductive elements 84A, 84B are mounted on the base 83, respectively electrically contact the conductive rings 82A, 82B, and are electrically connected to the power supply 3, so that the power supply 3 connected to an external power source supplies DC power to the LED elements 51 through the electrical connection device 8.

In the present embodiment, the resilient conductive elements 84A, 84B are conductive torque springs. The resilient conductive elements 84A, 84B are respectively mounted around different two of the pillars 831. Each resilient conductive element 84A, 84B has a conductive contact end 841A, 841B. The conductive contact ends 841A, 841B of the resilient conductive elements 84A, 84B electrically contact the corresponding conductive rings 82A, 82B.

With reference to FIGS. 1 and 6, the watertight lens assembly 6 is mounted on the open front end of the lamp case 1, is made of a transparent material, and has a lens plate 60 and a lens tube 61. The lens plate 60 can be hermetically mounted on the open front end of the lamp case 1 by way of being directly mounted on the open front end or being screwed on the open front end in collaboration with a waterproof O-ring. The lens tube 61 is centrally formed on and protrudes frontwards from a front side of the lens plate 60, and has a closed end, an open end, and a receiving chamber 610. The closed end is located on a front end of the lens tube 61. The open end is formed through a rear end of the lens tube 61 and the lens plate 60. The receiving chamber 610 is defined inside the lens tube 61, extends rearwards from the closed end to a rear side of the lens plate 60, and communicates with the open end, for the spindle 40 of the motor 4 and the LED device 5 on the positioning seat 41 mounted around the spindle 40 to be inserted into the receiving chamber 610 of the lens tube 61.

The beam-splitting lens cover 7 is made of a transparent material, and has a receiving space with a rear open end, and is mounted on the front side of the lens plate 60 with the rear open end facing the lens plate 60, so that the lens tube 61 can be inserted into the beam-splitting lens cover 7. The beam-splitting lens cover 7 further has multiple convex lenses 70 with multiple refraction angles formed on an inner surface of the beam-splitting lens cover 7. In the present embodiment, the beam-splitting lens cover 7 takes a hollow spherical form and is correspondingly combined by a front beam-splitting lens cover 71 and a rear beam-splitting lens cover 72.

With reference to FIGS. 2 and 3, when the rotary projector light is operated, the support stand 2 can be securely mounted in the ground or other fixture. With reference to FIG. 6, the externally connected power cable 31 of the power supply 3 is connected to an external AC power source. The power supply 3 converts the AC power into DC power and supplies the DC power to the motor 4 and the LED elements 51 of the LED device 5. This causes the LED elements 51 to emit light, and the motor 4 to drive the LED device 5 on the positioning seat 41 on the spindle 40 to rotate. Meanwhile, light with different colors emitted from the rotated LED elements 51 passes through the lens tube 61 of the watertight lens assembly 6, is projected onto the beam-splitting lens cover 7, and is refracted by the convex lenses 70 of the beam-splitting lens cover 7, so that light with different colors is scattered at multiple projection angles and spread in a wide range in the ambient environment.

The rotary projector light can further be independently or combinationally applied for many extension indoor or outdoor products, such as: lamp enclosures, textile costumes, inflatable costumes, inflatable character modeling objects, or rear projection enclosures. In terms of lamp enclosure, the rotary projector light can be mounted inside of an enclosure with translucency or semi-translucency, yielding outwardly projected patterns or rear-projected patterns upon the enclosure. In terms of textile or inflatable costumes, the rotary projector light can be mounted inside of or tangential to the costumes of different shapes. In terms of character modeling objects, a rotary projector light or multiple rotary projector lights can be mounted in character modeling objects that have different shapes, such as: realistic, cartoon, or abstract characters or other shaped renditions of a single or multiple characters. In terms of the rear projected patterns upon a translucent or semi-translucent enclosure, at least one rotary projector light that is mounted inside of the enclosure can yield projected patterns and/or rear-projected patterns upon the enclosure.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A rotary projector light, comprising:

a lamp case defining a hollow mounting chamber and having an open front end;

a power supply located inside the lamp case, the power supply connected to a power cable adapted to connect to an external power source;

a motor located inside the lamp case, the motor electrically connected to the power supply and having a spindle;

a positioning seat mounted on the spindle;

a plurality of light emitting diode (LED) elements located on the positioning seat, the LED elements electrically connected to the power supply; and a beam-splitting lens cover located on the open front end of the lamp case, the beam-splitting lens cover having an inner surface with multiple convex lenses directed at multiple refraction angles.

2. The rotary projector light of claim 1, further comprising a lens assembly mounted on the open front end of the lamp case and enclosing the LED elements within the hollow mounting chamber.

3. The rotary projector light of claim 2, wherein the beam-splitting lens cover defines an interior receiving space that receives the lens assembly.

4. The rotary projector light of claim 2, wherein the lens assembly forms a watertight seal with the hollow mounting chamber of the lamp case.

5. The rotary projector light of claim 1, wherein the plurality of LED elements are adapted to emit light of different colors.

6. The rotary projector light of claim 1, wherein:

the positioning seat defines a plurality of faces distributed around a central axis of the spindle of the motor; and at least one LED element is located on each face.

7. The rotary projector light of claim 6, wherein:

the plurality of faces of the positioning seat include a first face, a second face, and a third face;

a first LED element, a second LED element, and a third LED element are located on the first face, the second face, and the third face, respectively;

wherein each of the first LED element, the second LED element, and the third LED element is adapted to emit light of a different color.

8. The rotary projector light of claim 2, wherein the lens assembly comprises:

a lens plate hermetically mounted on the open front end of the lamp case; and a lens tube protruding from the lens plate away from the lamp case, the lens tube defining a receiving chamber adapted to receive the positioning seat and the LED elements.

9. The rotary projector light of claim 1, further comprising a support stand including:

a U-shaped bracket mounted on two lateral portions of the lamp case; and an insertion post tapered in a downward direction, the insertion post having an upper end rotatably mounted to the U-shaped bracket.

10. The rotary projector light of claim 1, further comprising:

an electrical connection device that electrically connects the LED elements to the power supply, the electrical connection device including:

an insulating sleeve mounted around the spindle of the motor and having a partition flange protruding radially outwardly from the insulating sleeve;

first and second conductive rings located on opposite sides of the partition flange;

first and second conductive wires electrically connecting the first and second conductive rings, respectively, to a terminal of each LED element;

first and second resilient conductive elements electrically connected to the power supply, the first and second resilient conductive elements contacting the first and second conductive rings, respectively.

11. The rotary projector light of claim 10, further comprising:

a base located within the hollow mounting chamber of the light case, the base defining a through hole for the spindle of the motor; and first and second pillars extending from the base;

wherein the first and second resilient conductive elements comprise conductive torque springs mounted around the first and second pillars, respectively.

12. The rotary projector light of claim 11, wherein each of the first and second conductive torque springs has a conductive contact end electrically contacting one of the first and second conductive rings.

13. The rotary projector light of claim 1, wherein the beam-splitting lens cover comprises a front beam-splitting lens cover and a rear beam-splitting lens cover.

14. A method of projecting multiple colors of light at multiple angles, comprising:

providing a rotary projector light having a lamp case and a beam-splitting lens cover, the rotary projector light further having a power source and a motor located within the lamp case;

rotating a plurality of different colored light emitting diode (LED) elements around an axis within the lamp case; and emitting light from the plurality of different colored LED elements, the light projecting through the beam-splitting lens cover;

transmitting electrical power from the power source to the motor to rotate the plurality of different colored LED elements; and transmitting electrical power from the power source to the plurality of different colored LED elements, wherein the beam-splitting lens refracts the light at multiple projection angles;

further wherein:

the motor includes a spindle supporting a positioning seat;

the positioning seat includes a first face, a second face, and a third face;

a first LED element, a second LED element, and a third LED element are located on the first face, the second face, and the third face, respectively; and each of the first LED element, the second LED element, and the third LED element is adapted to emit light of a different color.

* * * * *